US005392743A

United States Patent [19]

Dokonal

[11] Patent Number: 5,392,743

[45] Date of Patent: Feb. 28, 1995

[54] VARIABLE DURATION ROTARY VALVE

[76] Inventor: Jindrich Dokonal, 914 Mountain View Ave., Apt. 11, Mountain View, Calif. 94040

[21] Appl. No.: 219,083

[22] Filed: Mar. 28, 1994

[51] Int. Cl.[6] ..... F01L 7/02

[52] U.S. Cl. ..... 123/190.8; 123/190.1; 123/190.4

[58] Field of Search ..... 123/190.1, 190.4, 190.8, 123/90.18

[56] References Cited

U.S. PATENT DOCUMENTS

| | | | |
|---|---|---|---|
| 1,863,875 | 6/1932 | Rabezzana | 123/90.18 |
| 4,163,438 | 8/1979 | Guenther | 123/190.1 |
| 5,309,876 | 5/1994 | Schiattino | 123/190.2 |

FOREIGN PATENT DOCUMENTS

| | | | |
|---|---|---|---|
| 0059020 | 4/1982 | Japan | 123/190.1 |
| 0237825 | 10/1986 | Japan | 123/190.1 |
| 0187316 | 7/1989 | Japan | 123/190.1 |

*Primary Examiner*—Willis R. Wolfe
*Assistant Examiner*—Erick Solis

[57] ABSTRACT

A rotary valve which may be axially adjusted for varying an open duration of the valve. The device includes a rotary valve having a substantially wedge shaped, contoured aperture which allows passage of a combustion mixture through an intake port and into the combustion chamber of an engine during rotation of the valve. The rotary valve is slidably positioned upon a splined shaft which both rotates and permits axial movement of the valve, with such axial motion aligning various portions of the contoured aperture with the intake port to effect a controlled variance of the duration of time the valve permits flow through the port.

5 Claims, 5 Drawing Sheets

VARIABLE DURATION ROTARY VALVE

BACKGROUND OF THE INVENTION

1. Field of the Invention

The present invention relates to engine valves and more particularly pertains to a variable duration rotary valve which may be axially adjusted for varying an open duration of the valve.

2. Description of the Prior Art

The use of engine valves is known in the prior art. More specifically, engine valves heretofore devised and utilized for the purpose of varying a duration of the valve are known to consist basically of familiar, expected and obvious structural configurations, notwithstanding the myriad of designs encompassed by the crowded prior art which have been developed for the fulfillment of countless objectives and requirements.

For example, a rotary valve arrangement is illustrated in U.S. Pat. No. 4,517,938 which has a rotary valve member disposed within a housing and a series of circumferential dry-bearing, gas-sealing rings arranged to block leakage between adjacent passageways in the valve member.

Another patent of interest is U.S. Pat. No. 4,751,900 which teaches an adjustable segmented rotary twin port valve shaft useful for the introduction and exhaustion of gases of the internal combustion engine. The device includes an adjustable rotating valve shaft driven by the crank shaft, with the valve shaft having both intake and exhaust passages separated by annular sealing rings. The complete shaft assembly rotates in a lubricated bore, with the bore having access to openings to the combustion chambers of all cylinders of the engine. The rotating shaft rotates at one-fourth speed that of the crank shaft, thereby reducing wear and noise levels to a minimum, and providing full opening and closing of passages in shorter periods of time at proper sequence of valve timing, and eliminating all reciprocating parts which are found in conventional valve systems today.

Other known prior art engine valves include U.S. Pat. Nos.: 4,969,918; 3,522,797; 2,302,442; 2,156,749; 1,974,454; 1,923,666; 1,908,680; 1,724,458; 1,249,506; 1,213,027; and British Patent 25,291.

While these devices fulfill their respective, particular objectives and requirements, the aforementioned patents do not disclose a variable duration rotary valve which may be axially adjusted for varying an open duration of the valve which includes a rotary valve having a substantially wedge shaped, contoured aperture allowing passage of a combustion mixture through both an intake port and engine port and into the combustion chamber of an engine, whereby an axial movement of the valve aligns various portions of the contoured aperture with the intake port to effect a controlled variance of the duration of time the valve permits flow through the ports.

In these respects, the variable duration rotary valve according to the present invention substantially departs from the conventional concepts and designs of the prior art, and in so doing provides an apparatus primarily developed for the purpose of varying an open duration of the valve.

SUMMARY OF THE INVENTION

In view of the foregoing disadvantages inherent in the known types of engine valves now present in the prior art, the present invention provides a new variable duration rotary valve construction wherein the same can be utilized for varying an open duration of the valve. As such, the general purpose of the present invention, which will be described subsequently in greater detail, is to provide a new variable duration rotary valve apparatus and method which has many of the advantages of the engine valves mentioned heretofore and many novel features that result in a variable duration rotary valve which is not anticipated, rendered obvious, suggested, or even implied by any of the prior art engine valves, either alone or in any combination thereof.

To attain this, the present invention generally comprises a rotary valve which may be axially adjusted for varying an open duration of the valve. The device includes a rotary valve having a substantially wedge shaped, contoured aperture which allows passage of a combustion mixture through an intake port and into the combustion chamber of an engine. The rotary valve is slidably positioned upon a splined shaft which both rotates and permits axial movement of the valve, with such axial motion aligning various portions of the contoured aperture with the intake port to effect a controlled variance of the duration of time the valve permits flow through the port.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new variable duration rotary valve apparatus and method which has many of the advantages of the engine valves mentioned heretofore and many novel features that result in a variable duration rotary valve which is not anticipated, rendered obvious, suggested, or even implied by any of the prior art engine valves, either alone or in any combination thereof.

It is another object of the present invention to provide a new variable duration rotary valve which may be easily and efficiently manufactured and marketed.

It is a further object of the present invention to provide a new variable duration rotary valve which is of a durable and reliable construction.

An even further object of the present invention is to provide a new variable duration rotary valve which is susceptible of a low cost of manufacture with regard to both materials and labor, and which accordingly is then susceptible of low prices of sale to the consuming public, thereby making such variable duration rotary valves economically available to the buying public.

Still yet another object of the present invention is to provide a new variable duration rotary valve which provides in the apparatuses and methods of the prior art some of the advantages thereof, while simultaneously overcoming some of the disadvantages normally associated therewith.

Still another object of the present invention is to provide a new variable duration rotary valve which may be axially adjusted for varying an open duration of the valve.

Yet another object of the present invention is to provide a new variable duration rotary valve having a substantially wedge shaped, contour aperture which allows passage of a combustion mixture through an intake port and into the combustion chamber of the engine, whereby the rotary valve is slidably positioned upon a splined shaft which both rotates and permits axial movement of the valve, with such axial motion aligning various portion of the contoured aperture with the intake port to effect a controlled variance of the duration of time the valve permits flow through the intake port.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
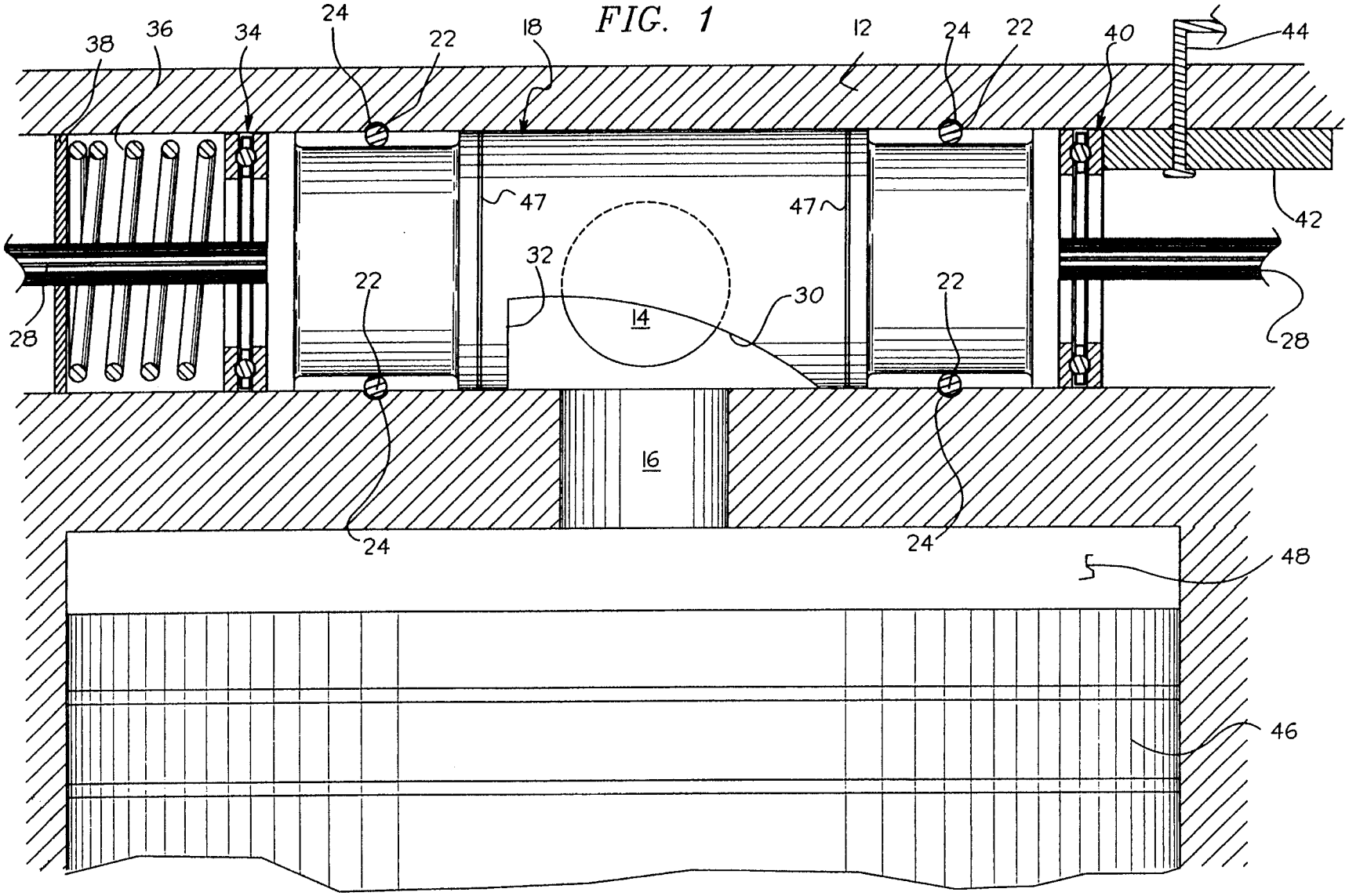
FIG. 1 is a cross-sectional view of a variable duration rotary valve assembly comprising the present invention.

With reference now to the drawings, and in particular to FIGS. 1–9 thereof, a new variable duration rotary valve embodying the principles and concepts of the present invention and generally designated by the reference numeral 10 will be described.

More specifically, it will be noted that the variable duration rotary valve 10 comprises a valve cylinder 12 having a substantially circular interior with a manifold intake port 14, an exhaust port 15, and an engine port 16 communicating with the interior of the valve cylinder. The manifold intake port 14 further communicates with an air fuel mixture supplying device such as a carburetor, fuel injector, or the like, the exhaust port 15 communicates with the exhaust system of the associated vehicle, and the engine port 16 communicates with the combustion chamber 48 of the engine. A rotary valve 18 is rotatably and slidably positioned within the valve cylinder 12 and includes a pair of elongated journals 20 formed at opposed ends thereof, as best illustrated in FIG. 2. The elongated journals 20 are operable to engage ball bearings 22 retained within narrow journals 24 circumferentially formed about an interior surface of the valve cylinder 12. By this structure, the rotary valve 18 is free to both rotate about its longitudinal axis, as well as slide axially within the valve cylinder 12. As further illustrated in FIG. 2, the rotary valve 18 has a journaled bore 26 extending longitudinally therethrough, with the bore being concentrically received about a splined shaft 28. The splined shaft 28 is provided with a plurality of splines which engage the grooves present within the journaled bore 26, thereby allowing a rotational torque to be imparted to the rotary valve through the splined shaft 28, while simultaneously permitting axial motion of the rotary valve relative to the splined shaft. The splined shaft 28 is preferably connected to a timing mechanism of the engine, such as a timing chain, timing belt, or the like, such that the splined shaft rotates at one-half speed that of the crank shaft of the engine. In addition, seals 47, of a construction similar to piston rings or the like, may be positioned circumferentially about the rotary valve 18 on opposed sides of the contoured aperture 30, as illustrated in FIG. 1.

Figure 5:
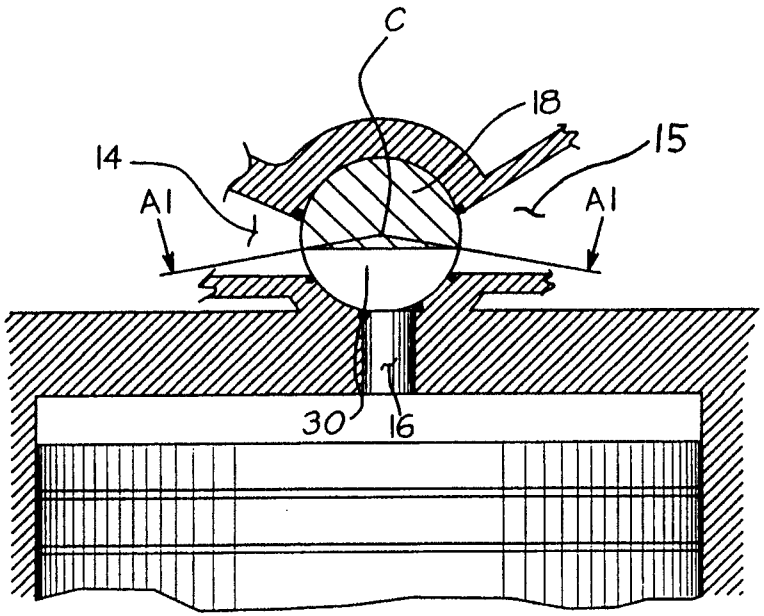
FIG. 5 is a cross-sectional view taken along line 5—5 of FIG. 4.
Figure 4:
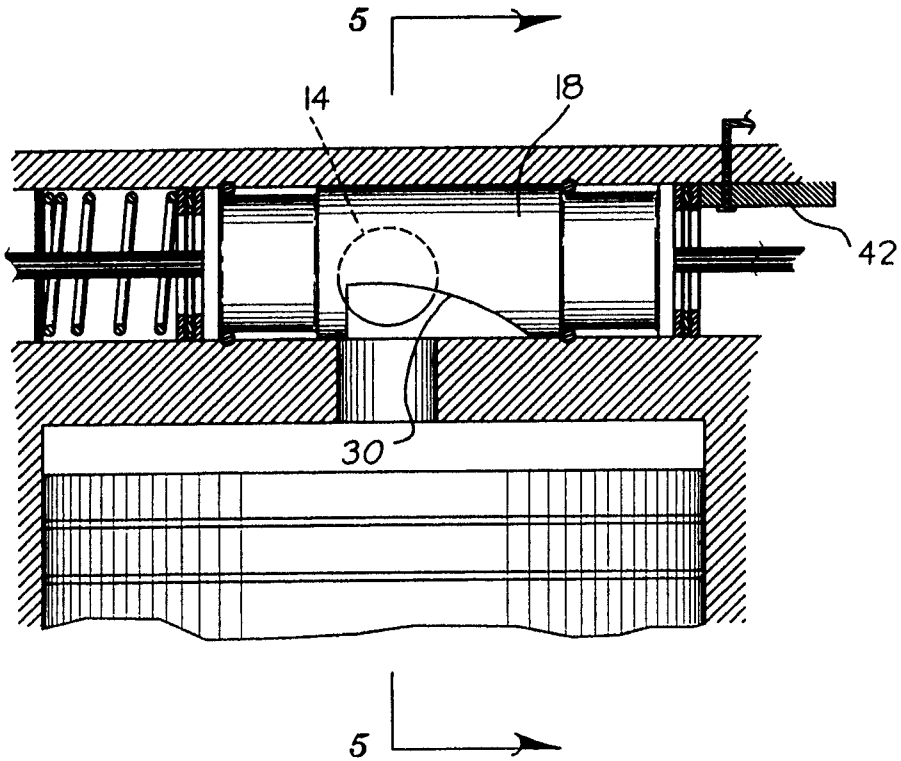
FIG. 4 is a cross-sectional view illustrating the rotary valve in a maximum position.

With further reference to FIG. 2, it can be shown that the rotary valve 18 further comprises a contoured aperture 30 which extends from an outer periphery of the rotary valve to a point just below the longitudinal axis of the rotary valve, whereat it intersects a vertical wall 32 extending radially outward to the outer periphery. Referring now to FIG. 5, it is shown how the contoured aperture 30 allows for variable duration communication between the manifold intake port 14 and the engine port 16, or between the exhaust port 15 and the engine port 16, during a predetermined angular displacement, with such angular displacement being related to an axial position of the valve 18 within the valve cylinder 12 in a manner which will henceforth be further described.

Figure 2:
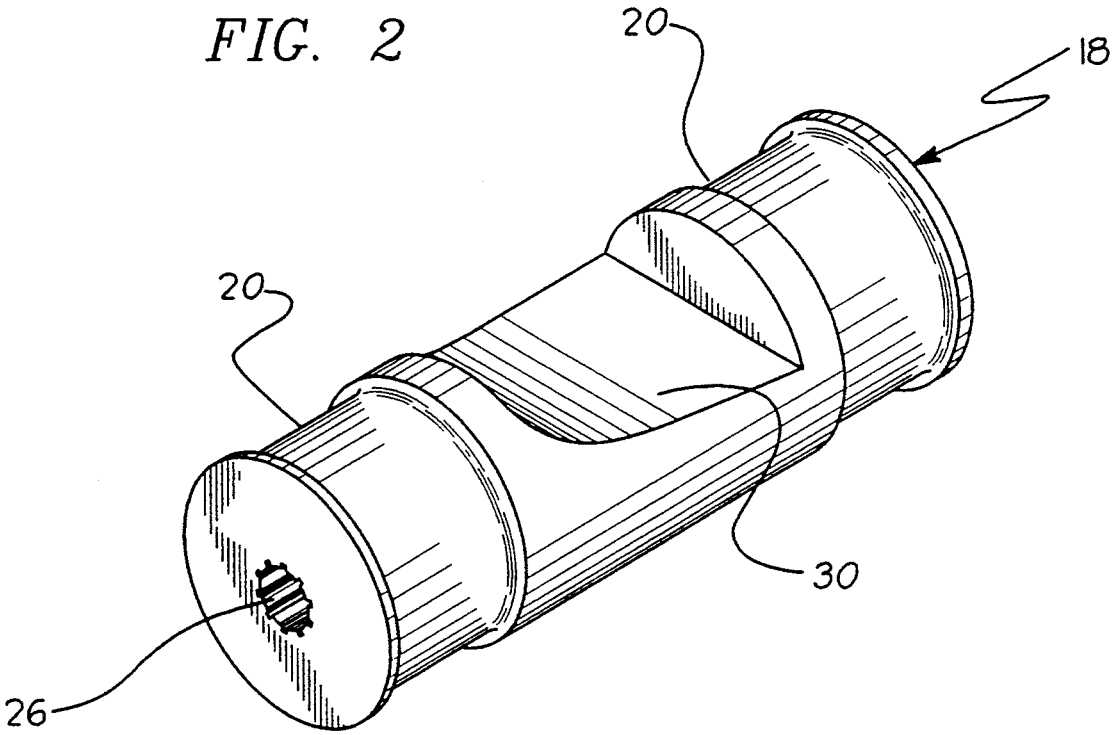
FIG. 2 is an isometric of the rotary valve forming a portion of the present invention.
Figure 3:
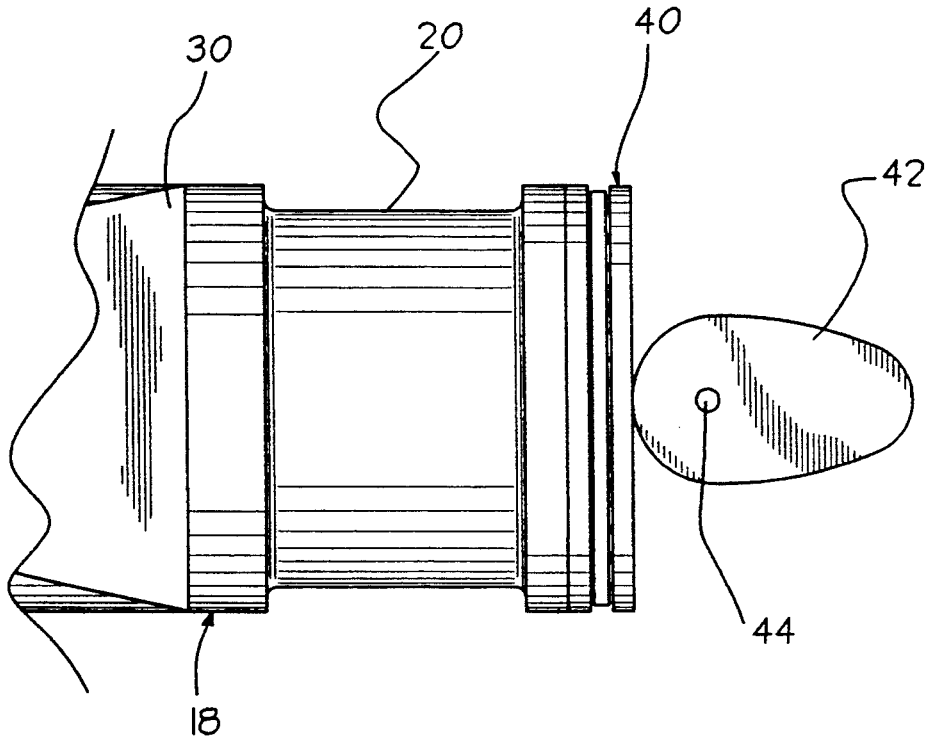
FIG. 3 is a top plan view of the rotary valve engaged to a cam.

To effect axial movement of the rotary valve 18 within the valve cylinder 12, a thrust bearing 34 is positioned in abutting relationship to a first end of the rotary valve, with the thrust bearing 34 engaging a return spring 36 interposed between the thrust bearing and an abutment plate 38, as best illustrated in FIG. 1. Positioned at a second end of the rotary valve 18 is a further thrust bearing 40 against which a pivotally mounted cam 42 engages, as best illustrated in FIG. 3. The cam 42 is pivotally mounted within the valve cylinder 12 by a cam actuator 44 which further serves to effect rotation of the cam to impart an axial motion of the rotary valve 18 against a force of the return spring 36, thereby adjustably positioning the various portions of the contoured aperture 30 in line with the ports 14 or 15, and 16.

FIGS. 4–9 illustrate an effect of the axial movement of the rotary valve 18 within the valve cylinder 12. The rotary valve 18 is illustrated in a maximum position in the cross-sectional view of FIG. 4. Such positioning results in a large portion of the contoured aperture 30 being positioned in line with the ports 14 or 15, and 16. This results in an open valve duration directly proportional to an angle "A1" defined by a center point "C" of the rotary valve 18 and the edges of the contoured aperture 30, as illustrated in FIG. 5. Thus, with the rotary valve 18 positioned in the maximum position, communication between the ports 14 or 15, and 16 is at a maximum duration during rotation of the rotary valve.

Figure 7:
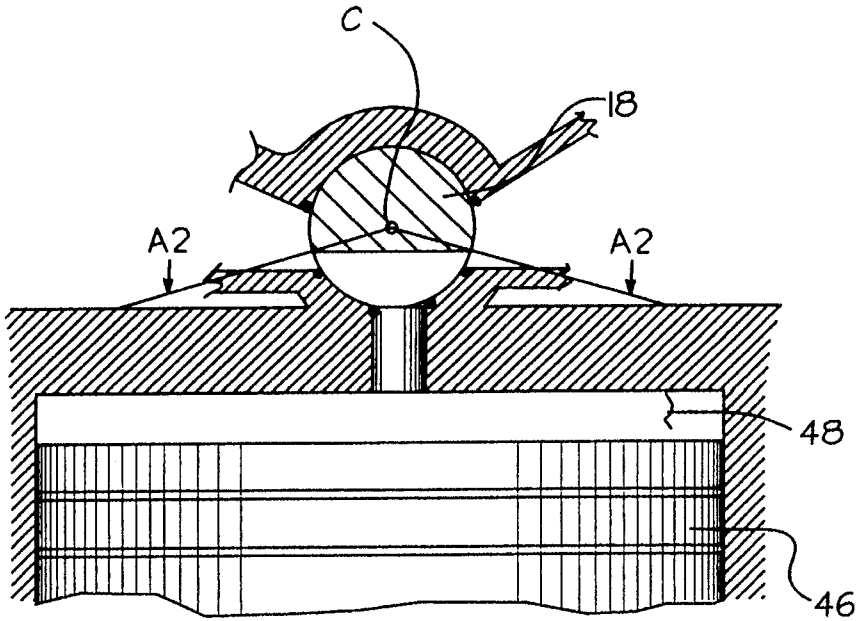
FIG. 7 is a cross-sectional view taken along line 7—7 of FIG. 6.
Figure 6:
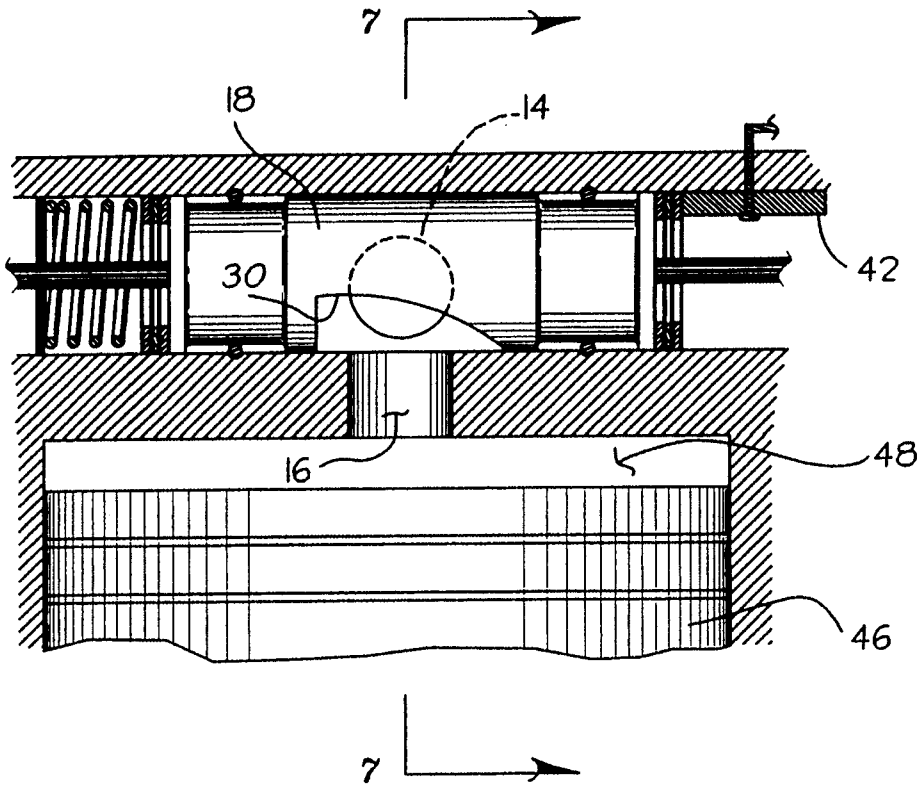
FIG. 6 is a cross-sectional view illustrating the rotary valve in a medium position.
Figure 9:
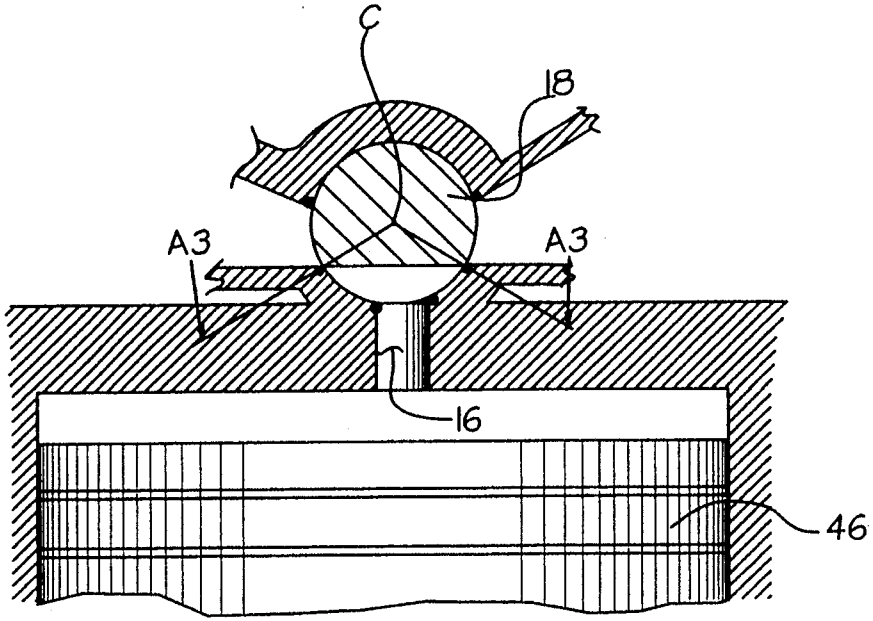
FIG. 9 is a cross-sectional view taken along line 9—9 of FIG. 8.
Figure 8:
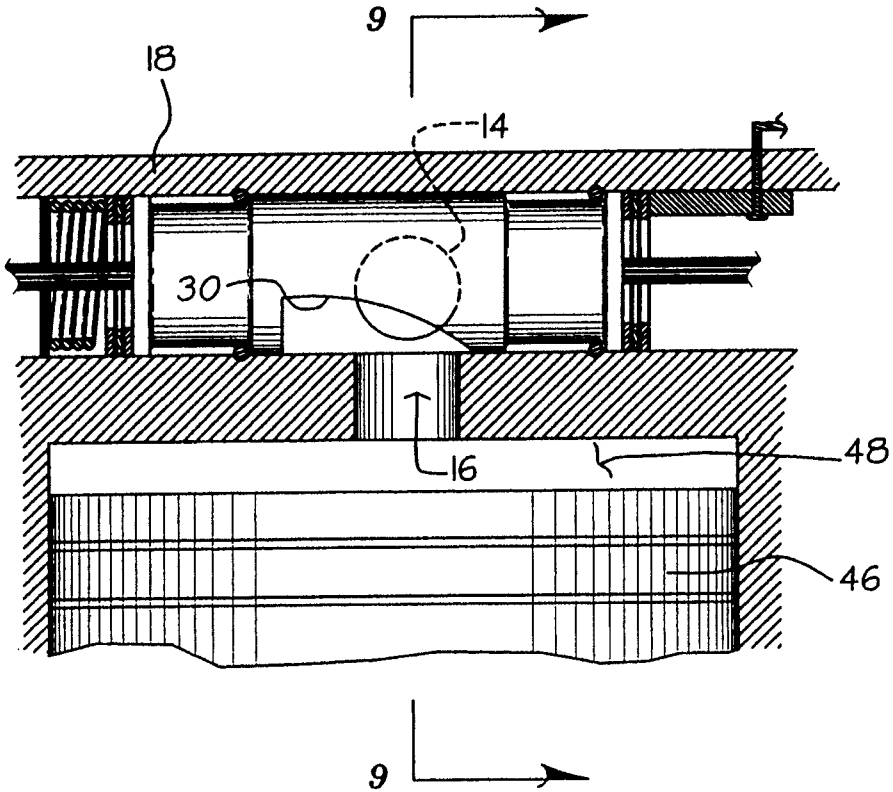
FIG. 8 is a cross-sectional view illustrating the rotary valve in a minimum position.

Referring now to FIGS. 6 and 7, it can be shown the rotary valve 18 is positioned in a medium position within the valve cylinder 12, with the angle "A2" being substantially less than the angle "A1", thereby resulting in a shorter duration of communication between the ports 14 or 15, and 16 as the valve rotates. Lastly, it can be seen in FIGS. 8 and 9 that the rotary valve 18 is positioned in a minimum position within the valve cylinder 12, with the angle "A3", as illustrated in FIG. 9, being substantially less than the angle "A2", thereby resulting in an even shorter duration of communication between the ports 14 or 15, and 16 as the valve rotates.

In operation, the cam actuator 44 may be connected to an engine controller of the automobile, such as a computerized controller, a throttle, the gas pedal of the vehicle, or the like, whereby axial movement of the valve 18 within the valve cylinder 12 may be simultaneously accomplished in accordance with an operation of the engine. Thus the variable duration rotary valve 10 allows a combustion mixture to enter the combustion chamber 48 as the piston 46 moves downwardly during the intake stroke, with an axial movement of the rotary valve 18 within the valve cylinder. 12 effecting an infinitely variable adjustment of the duration of communication between the ports 14 or 15, and 16.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed and desired to be protected by LETTERS PATENT of the United States is as follows:

1. A variable duration rotary valve comprising:

a valve cylinder having a circular cross-sectional interior with an intake port, an exhaust port, and an engine port in communication with said interior, said cylinder including a pair of spaced, narrow, circumferentially extending journals within said interior;

a rotary valve having a first end and a second end with a first elongated journal extending circumferentially around said valve proximate said first end thereof, and a second elongated journal extending circumferentially around said valve proximate said second end thereof, said rotary valve further having a journaled bore extending longitudinally therethrough and a contoured aperture having an arcuate shape extending from an outer periphery of said valve to a radially extending wall, said rotary valve being positioned within said valve cylinder;

a plurality of ball bearings interposed between said narrow journals and said elongated journals;

a splined shaft extending through said journaled bore for rotating said valve;

an abutment plate mounted within said valve cylinder;

a first thrust bearing positioned in abutting relation to said first end of said rotary valve;

a spring interposed between said abutment plate and said first thrust bearing;

a second thrust bearing positioned in abutting relation to said second end of said rotary valve;

a cam rotatably mounted within said valve cylinder, said cam being engaged against said second thrust bearing and operable to bias said rotary valve against a force of said spring;

and, means for rotating said cam.

2. A variable duration rotary valve comprising:

a valve cylinder having a circular cross-sectional interior with an intake port, an exhaust port, and an engine port in communication with said interior;

a rotary valve having a first end and a second end with a contoured aperture having an arcuate shape extending from an outer periphery of said valve to a radially extending wall, said rotary valve being positioned within said valve cylinder and adapted to allow for variable duration during communication between the intake port and the engine port and also between the exhaust port and the engine port;

bearing means for rotatably supporting said rotary valve within said valve cylinder and permitting axial movement of said rotary valve within said valve cylinder;

means for rotating said rotary valve; and means for axially moving said rotary valve within said valve cylinder.

3. The variable duration rotary valve of claim 2, wherein said rotary valve has a journaled bore extending longitudinally therethrough, and further wherein said means for rotating said rotary valve comprises a splined shaft extending through said journaled bore, said splined shaft being connectable to a timing gear of an engine.

4. The variable duration rotary valve of claim 3, wherein said cylinder has a pair of spaced, narrow, circumferentially extending journals within said interior, and said rotary valve has a first elongated journal extending circumferentially around said valve proximate said first end thereof and a second elongated journal extending circumferentially around said valve proximate said second end thereof, and further wherein said bearing means comprises a plurality of ball bearings interposed between said narrow journals and said elongated journals.

5. The variable duration rotary valve of claim 4, wherein said means for effecting axial motion of said rotary valve within said valve cylinder comprises an abutment plate mounted within said valve cylinder;

a first thrust bearing positioned in abutting relation to said first end of said rotary valve, a spring interposed between said abutment plate and said first thrust bearing, a second thrust bearing positioned in abutting relation to said second end of said rotary valve and a cam rotatably mounted within said valve cylinder wherein said cam is engaged against said second thrust bearing and operable to bias said rotary valve against a biasing force of said spring.

* * * * *